US006432606B1

(12) United States Patent
Claes et al.

(10) Patent No.: US 6,432,606 B1
(45) Date of Patent: Aug. 13, 2002

(54) PHOTOGRAPHIC RECORDING MATERIAL

(75) Inventors: Roland Claes, Dendermonde; Stefaan Lingier, Assenede; Etienne Van Thillo, Essen, all of (BE)

(73) Assignee: Agfa-Gevaert, Mortsel (BE)

( * ) Notice: Subject to any disclaimer, the term of this patent is extended or adjusted under 35 U.S.C. 154(b) by 0 days.

(21) Appl. No.: 09/891,962

(22) Filed: Jun. 26, 2001

Related U.S. Application Data

(60) Provisional application No. 60/217,106, filed on Jul. 10, 2000.

(30) Foreign Application Priority Data

Jul. 7, 2000 (EP) ..... 00202410

(51) Int. Cl.[7] ..... G03C 1/795; G03C 1/08; G03C 1/74; G03C 1/89; G03C 1/835

(52) U.S. Cl. ..... 430/264; 430/517; 430/529; 430/508; 430/533; 430/534; 430/535

(58) Field of Search ..... 430/264, 508, 430/534, 535, 533, 517

(56) References Cited

U.S. PATENT DOCUMENTS

| | | | | | |
|---|---|---|---|---|---|
| 4,994,353 | A | | 2/1991 | Hatakeyama et al. | 430/496 |
| 5,061,611 | A | * | 10/1991 | Sakata et al. | 430/535 |
| 5,705,329 | A | | 1/1998 | Nakajima et al. | 430/536 |
| 5,932,390 | A | * | 8/1999 | Ishigaki et al. | 430/264 |
| 6,013,410 | A | * | 1/2000 | Arai | 430/535 |

* cited by examiner

*Primary Examiner*—Richard L. Schilling
(74) *Attorney, Agent, or Firm*—Joseph T. Guy; Nexsen Pruet Jacobs & Pollard, LLC

(57) ABSTRACT

A red sensitive photographic recording material is disclosed having an emulsion layer with low silver halide and low binder content. It further comprises a polyester support having subbing layers on both sides and an anti-halation layer on the back side.

7 Claims, No Drawings

PHOTOGRAPHIC RECORDING MATERIAL

Benefit is claimed under 35USC 119(E) based on U.S. provisional application Ser. No. 60/217,106 filed Jul. 10. 2000.

FIELD OF THE INVENTION

The present invention relates to an improved photographic recording material for graphic arts prepress.

BACKGROUND OF THE INVENTION

Photosensitive materials based on silver halide chemistry are used in a lot of applications, e.g. photographic materials for general amateur and professional photography in black-and white or color, recording and printing materials for the motion picture industry, and materials for the recording and duplication of medical diagnostic images. Further specific materials are developed for micrography, non-destructive testing and graphic arts pre-press. In graphic arts reproduction processes the original image appearing to have a continuous tone gradation is reproduced in a screening process by a collection of large number of dots, either by optical means in the case of a camera film or by electronic means in case of a recorder film. Apart from camera and recorder films there exist also so-called contact films which are able to duplicate screened images. In several photographic areas but in particular in graphic arts prepress films there is permanent need for lower manufacturing costs, higher covering power, sharper images, and reduced replenishment rates. This is especially the case for films with a great turnover such as a graphic arts recorder film which is designed for the recording of screened images, linework and text electronically stored in an image-setter or scanner.

OBJECTS OF THE INVENTION

It is an object of the present invention to provide a graphic arts recording film with improved covering power.

It is a further object of the present invention to provide a graphic arts recording film with lowered manufacturing costs.

SUMMARY OF THE INVENTION

The above mentioned objects are realized by providing a photographi recording material for graphic arts comprising a polyester support, subbed on both front and back sides with a latex subbing layer, and further comprising on the front side a gelatin subbing layer, one or more red sensitized emulsion layers having a total silver coverage of at most 3.6 $g/m^2$ Ag (correspondin to 5.5 $g/m^2$, expressed as $AgNO_3$), and a total dry coverage of all other solid ingredients of at most 1.5 $g/m^2$, and one or more anti-abrasive layers.

In a preferred embodiment the photographic recording material further comprises on the back side an antihalation layer comprising at most 1.5 $g/m^2$ of gelatin and an antihalation dye.

DETAILED DESCRIPTION OF THE INVENTION

The different elements of the invention will now be explained in detail.

The Emulsion Layer

The recording material of the present invention contains one or more emulsion layers, containing silver halide grains, a binder and other solid ingredients. In a most preferred embodiment of this invention there is just one emulsion layer. It is an essential feature of the present invention that the total silver coverage is at most 3.6 $g/m^2$ Ag (corresponding to 5.5 $g/m^2$ expressed as $AgNO_3$). It is a further essential feature of the present invention that the total dry coverage of all other solid ingredients is at most 1.5 $g/m^2$.

Graphic arts recording materials preferably use emulsions containing a majority of chloride, preferably between 50 mole % and 95 mole %, most preferably between 60 mole % and 89 mole %, and a low amount of iodide, the remaining halide being bromide.

The photographic emulsion(s) can be prepared from soluble silver salts and soluble halides according to different methods as described e.g. by P. Glafkidès in "Chimie et Physique Photographique", Paul Montel, Paris (1967), by G. F. Duffin in "Photographic Emulsion Chemistry", The Focal Press, London (1966), and by V. L. Zelikman et al in "Making and Coating Photographic Emulsion", The Focal Press, London (1966). They can be prepared by mixing the halide and silver solutions in partially or fully controlled conditions of temperature, concentrations, sequence of addition, and rates of addition. The silver halide can be precipitated according to the single-jet method, the double-jet method, the conversion method or an alternation of these different methods.

The silver halide emulsions can be doped with various metal salts or complexes such as Rhodium and Iridium dopants.

The emulsion can be desalted in the usual ways e.g. by dialysis, by flocculation and re-dispersing, or by ultrafiltration.

The light-sensitive silver halide emulsions are preferably chemically sensitized as described e.g. in the above-mentioned "Chimie et Physique Photographique" by P. Glafkidès, in the above-mentioned "Photographic Emulsion Chemistry" by G. F. Duffin, in the above-mentioned "Making and Coating Photographic Emulsion" by V. L. Zelikman et al, and in "Die Grundlagen der Photographischen Prozesse mit Silberhalogeniden" edited by H. Frieser and published by Akademische Verlagsgesellschaft (1968). As described in said literature chemical sensitization can be carried out by effecting the ripening in the presence of small amounts of compounds containing sulphur e.g. thiosulphate, thiocyanate, thioureas, sulphites, mercapto compounds, and rhodamines. The emulsions can be sensitized also by means of gold-sulphur ripeners, gold-selenium ripeners or by means of reductors e.g. tin compounds as described in GB 739,823, amines, hydrazine derivatives, formamidine-sulphinic acids, and silane compounds. Chemical sensitization can also be performed with small amounts of Ir, Rh, Ru, Pb, Cd, Hg, Tl, Pd, Pt, or Au. One of these chemical sensitization methods or a combination thereof can be used.

The light-sensitive silver halide emulsions can be red sensitized with proper dyes such as those described by F. M. Hamer in "The Cyanine Dyes and Related Compounds", 1964, John Wiley & Sons. Dyes that can be used for the purpose of spectral sensitization include cyanine dyes, merocyanine dyes, complex cyanine dyes, complex merocyanine dyes, hemicyanine dyes, styryl dyes and hemioxonol dyes. Particularly valuable dyes are those belonging to the cyanine dyes, merocyanine dyes and complex merocyanine dyes. Specific patents on red sensitizers include U.S. Pat. No. 4,717,650, FR 2 058 405 and EP 427892.

The silver halide emulsion(s) for use in accordance with the present invention may comprise compounds preventing the formation of fog or stabilizing the photographic characteristics during the production or storage of photographic elements or during the photographic treatment thereof. Many known compounds can be added as fog-inhibiting agent or stabilizer to the silver halide emulsion. Suitable examples are disclosed in *Research Disclosure* Item 36544, September 1994, Chapter VII.

Besides the silver halide another essential component of a light-sensitive emulsion layer is the binder. The binder is a hydrophilic colloid, preferably gelatin. Gelatin can, however, be replaced in part or integrally by synthetic, semi-synthetic, or natural polymers.

The binders of the photographic element, especially when the binder used is gelatin, can be hardened with appropriate hardening agents such as those of the epoxide type, those of the ethylenimine type, those of the vinylsulfone type e.g. 1,3-vinylsulpohonyl-2-propanol, chromium salts e.g. chromium acetate and chromium alum, aldehydes e.g. formaldehyde, glyoxal, and glutaraldehyde, N-methylol compounds e.g. dimethylolurea and methyloldimethylhydantoin, dioxan derivatives e.g. 2,3-dihydroxy-dioxan, active vinyl compounds e.g. 1,3,5-triacryloyl-hexahydro-s-triazine, active halogen compounds e.g. 2,4-dichloro-6-hydroxy-striazine, and mucohalogenic acids e.g. mucochloric acid and mucophenoxychloric acid. These hardeners can be used alone or in combination. The binders can also be hardened with fast-reacting. hardeners such as carbamoylpyridinium salts as disclosed in U.S. Pat. No. 4,063,952.

In a preferred embodiment of the present invention the emulsion layer further contains a polymeric latex functioning as plasticizer. A preferred latex is copoly(AMPS-butylmethacrylate), wherein AMPS means 2-acrylamido-2-methylpropane sulphonic acid, sodium salt, a monomer from Lubrizol Co. In a most preferred embodiment the latex is present in an amount of at least 15% by weight of all solids the silver halide grains excluded.

The photographic emulsion layer may further comprise various kinds of surface-active agents and lubricants in the photographic emulsion layer or in another hydrophilic colloid layer. Suitable surface-active agents and lubricants are disclosed in *Research Disclosure* Item 36544, September 1994, Chapter IX.

The Anti-abrasive Layer(s)

Usually in photographic materials there is only one anti-abrasive layer. on top of the emulsion layer. However, in a preferred embodiment of the present invention there are two thin anti-abrasive layers. In a still more preferred embodiment the anti-abrasive layer closest to the support contains a mixture of gelatin and a latex. In a most preferred embodiment this layer contains about 0.5 g/m$^2$ of gelatin and about 0.5 g/m$^2$ of latex. The latex uses may be the same as the latex optionally present in the emulsion layer. The top anti-abrasive layer is a gelatinous layer preferably withhout latex. Preferably its gelatin coverage is also about 0.5 g/m$^2$. The anti-abrasive. layer may further contain spacing agents, wetting agents and lubricants, e.g. polyethylene dispersion.

The Latex Subbing Layers

The polyester support of the recorder film of the present invention is subbed on both sides with a so-called latex subbing layer. An essential ingredient of this latex subbing layer is an, adhesion promoting latex. A preferred class of latex polymers for this purpose are vinylidene chloride-containing copolymers having carboxyl functional groups. Illustrative of such polymers are (1) copolymers of vinylidene chloride and an unsaturated carboxylic acid such as acrylic or methacrylic acid, (2) copolymers of vinylidene chloride and a half ester of an unsaturated carboxylic acid such as the monomethylester of itaconic acid, (3) terpolymers of vinylidene chloride, itaconic acid and an alkyl acrylate or rethacrylate such as ethyl acrylate or methyl methacrylate, and (4) terpolymers of vinylidene chloride, acrylonitrile or methacrylonitrile and an unsaturated carboxylic acid such as acrylic acid or methacrylic acid.

In a most preferred embodiment the latex polymer is co(vinylidene chloride-methyl acrylate-itaconic acid 88%/10%/2%). This copolymer is prepared by emulsion polymerization using 0.5% MERSOLAT H (trade-mark of Bayer AG) as emulsifying agent. It is necessary to add extra surfactant, a so-called post-stabilizer, to the latex in order to assure a good stability on storage. An excellent storage stability is obtained when 4% of ULTRAVON W, trade mark of Ciba-Geigy, or DOWFAX, trade mark of Dow, is used.

As a further preferred ingredient of the coating solution of the latex subbing layer colloidal silica may be added as a binder. A preferred compound is KIESELSOL 100F (trademark of Bayer AG), average particle size 25–30 nm. The ratio of the amount of latex to silica is preferably about 80/20.

The dry thickness of the latex subbing layer is preferably about 0.1 mm.

The latex subbing layer of the back side is preferably of similar composition as the latex subbing layer on the upper side. However, in a particularly preferred embodiment this layer further contains a conductive polymer in order to make the layer antistatic. The nature of this conductive compound will now be explained in detail.

Such a compound, usually a polymer, can show ionic or electronic conductivity. The conductivity however of an antistatic layer containing ionic conductive polymers, even after cross-linking, is moisture dependent. Therefore electronically-conducting conjugated polymers have been developed. Substances having electronic conductivity instead of ionic conductivity have a conductivity independent from moisture. They are particularly suited or use in the production of antistatic layers with permanent and r producible conductivity.

Many of the known electronically conductive polymers are highly colored which makes them less suited for use in photographic materials, but some of them of the group of the polyarenemethylidenes, e.g. polythiophenes and polyisothianaphthene are not prohibitively colored and transparent, at least when coated in thin layers. As a result polythiophene derivatives are a preferred type of conductive compounds for use in the present invention.

The production of conductive polythiophenes is described in preparation literature mentioned in the above mentioned book: "Science and Applications of Conducting Polymers", p. 92.

For ecological reasons the coating of antistatic layers should proceed where possible from aqueous solutions by using as few as possible organic solvents. The production of antistatic coatings from aqueous coating compositions being dispersions of polythiophenes in the presence of polyanions is described in EP 0 440 957. Thanks to the presence of the polyanion the polythiophene compound is kept in dispersion.

Preferably said polythiophene has thiophene nuclei substituted with at least one alkoxy group, or —$O(CH_2CH_2O)_nCH_3$ group, n being 1 to 4, or, most preferably, thiophene nuclei that are ring closed over two oxygen atoms with an alkylene group including such group in substituted form.

Preferred polythiophenes for use according to the present invention are made up of structural units corresponding to the following general formula:

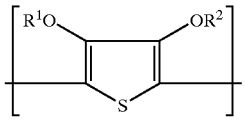

in which:

each of $R^1$ and $R^2$ independently represents hydrogen or a $C_{1-4}$ alkyl group or together represent an optionally substituted $C_{1-4}$ alkylene group or a cycloalkylene group, preferably an ethylene group, an optionally alkyl-substituted methylene group, an optionally $C_{1-12}$ alkyl—or phenyl-substituted 1,2-ethylene group, a 1,3-propylene group or a 1,2-cyclohexylene group.

The most preferred compound is poly(3,4-ethylenedioxythiophene), (PEDT) with following formula:

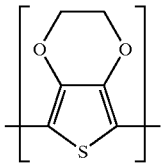

The preparation of said polythiophene and of aqueous polythiophene-polymeric polyanion dispersions containing said polythiophene is described in EP 0 440 957, cited above.

Suitable polymeric polyanion compounds required for keeping said polythiophenes in dispersion are provided by acidic polymers in free acid or neutralized form. The acidic polymers are preferably polymeric sulphonic acids. Examples of such polymeric acids are polymers containing vinyl sulfonic acid and styrene sulfonic acid or mixtures thereof.

The anionic acidic polymers used in conjunctio[008e] with the dispersed polythiophene polymer have preferably a content of anionic groups of more than 2% by weight with respect to said polymer compounds to ensure sufficient stability of the dispersion. Suitable acidic polymers or corresponding salts are described e.g. in DE-A -25 41 230, DE-A-25 41 274, DE-A-28 35 856, EP-A-14 921, EP-A-69 671, EP-A-130 115, U.S. Pat. No. 4,147,550, U.S. Pat. No. 4,388,403 and U.S. Pat. No. 5,006,451.

The weight ratio of polythiophene polymer to polymeric polyanion compound(s) can vary widely, for example from about 50/50 to 15/85.

The most preferred polymeric polyanion for use in combination with the polythiophene derivative, e.g. PEDT, is polystyrene sulphonate (PSS).

The conductive latex subbing layer has preferably a dry thickness of about 0.1 mm.

The Gelatin Subbing Layer

The gelatin subbing layer is coated on top of the the latex subbing layer on the front side. Apart from the spacing agent the gelatin subbing layer preferably contains a mixture of gelatin and colloidal silica. A preferred compound is again KIESELSOL 300F (trade-mark of Bayer AG). A plasticizing compound can be used in order to avoid the formation of cracks in the dried layer due to the occurence of excessive shrinking of the layer during drying. Plasticizing agents are well-known in the art. Low-molecular weight compounds (e.g. acetamide, glycerin) as well as polymeric latices (e.g. polyethylacrylate, poly-n.-butylacrylate) can be used for this purpose. Furtheron the gelatin subbing layer may contain one or more surfactants. Useful surfactants include: ULTRAVON™ W, an aryl sulfonate from CIBA-GEIGY, DOWFAX from Dow CO., and ARKOPAL™ N060 (previously HOSTAPAL™ W), a nonylphenylpolyethyleneglycol from HOECHST.

The thickness of the gelatin subbing layer is preferably comprised between 0.1 and 1 $\mu$m.

The Antihalation Layer

In a most preferred embodiment of the present invention an antihalation layer is present on the back side of the support on top of the latex subbing layer. An antihalation layer contains an antihalation dye and a binder. Antihalation dyes improve the image sharpness by diminishing the upward reflection of light by the support into the emulsion layer. Useful dyes absorbing in the visible spectral region include the colored piments of U.S. Pat. No. 2,697,037, the pyrazonol oxonol dyes of U.S. Pat. No. 2,274,782, the styryl and butadienyl dyes of U.S. Pat. No. 3,432,207, the diaryl azo dyes of U.S. Pat. No. 2,956,879, the merocyanine dyes of U.S. Pat. No. 2,527,583, the merocyanine and oxonol dyes of U.S. Pat. No. 3,486,897, U.S. Pat. No. 3,652,284 and U.S. Pat. No. 3,718,472, and the enaminohemioxonol dyes of U.S. Pat. No. 3,976,661. Dyes absorbing in the red spectral region of the di- or triphenylmethane type, some of which bear an electron-withdrawing group, are disclosed in e.g. U.S. Pat. No. 2,282,890, DE 1038395, FR 2,234,585, JP-A 59-228250, U.S. Pat. No. 2,252,052 and A. Guyot, Compt. Rend., Vol 114 (1970), p.1120. Some of the compounds disclosed contain one or more water-solubilizing groups.

It can be advantageous that the antihalation dye is non-diffusible under normal coating conditions and only becomes diffusible and/or discolors under alkaline processing conditions. Such dyes can be incorporated as dispersions or as so-called microcrystalline solid particles. Non-diffusible or hardly diffusible dyes of this type are described in e.g. U.S. Pat. No. 4,092,168, EP 274723, EP 276566, EP 294461, EP 299435, GB 1563809, EP 015601, U.S. Pat. No. 4,857,446, JP-A 02-259752, JP-A 02-264247, EP 582753, EP 587229.

It is an essential feature of the present invention that the antihalation layer is a thin layer having a gelatin coverage of at most 1.5 g/m$^2$.

Coating Technology

In a particularly preferred embodiment the two latex subbing layers, the gelatin subbing layer, and the antihalation layer are coated "on line" in a continuous process in the manufacturing alley of the polyester itself. Molten polyester is extruded and longitudinally stretched. Then the first latex subbing layer is applied on the upper side and the second latex subbing layer, optionally conductive, is applied on the back side. Then the subbed polyester is stretched in the transversal direction. The gelatin subbing layer is applied on the upper side, and finally the antihalation layer is applied on the back side.

The emulsion layer(s) and the anti-abrasive layers are coated "off-line". Any well-known coating technique can be used such as dip coating, air-knife coating, slide hopper coating, and curtain coating. In a preferred embodiment the emulsion layer and the two anti-abrasive layers are applied by curtain coating.

The invention will now be illustrated by the following examples without however being limited thereto.

EXAMPLES

Example 1

Comparison

Preparation of the the Polyester Sample

The polyester support in all examples was a polyethylene terephthalate (PET) support of 100 μm thickness.

Composition of the backing subbing layers: a first conductive subbing layer containing 180 mg/m$^2$ of a terpolymer of vinylidene chloride/methyl acrylate/itaconic acid (88%/10%/2%), 20 mg/m$^2$ of colloidal silica (surface area 100 m$^2$/g), and 3.15 mg/m$^2$ of poly(3,4-ethylenedioxythiophene)/poly(styrene sulphonate) complex; then a gelatin backin layer holding 0.2g of gelatin/m$^2$, 0.2 g/m$^2$ of colloidal silica and 1 mg/m$^2$ of 3 μm PMMA (polymethylmethacrylate) matting agent were coated.

Composition of the emulsion side subbing layers: a latex subbing layer containing 162 mg/m$^2$ of a terpolymer of vinylidene chloride/methyl acrylate/itaconic acid (88%/10%/2%), and 40 mg/m$^2$ of colloidal silica; then a gelatin subbing layer containing 0.2 g/m$^2$ of gelatin, 0.2 g/m$^2$ of colloidal silica, and 1 mg/m$^2$ of a 3 μm PMMA matting agent.

Both backing layers and emulsion side subbing layers were coated during polyester production.

Preparation of the Emulsion

To an aqueous gelatin solution (23.3 g gelatin/mol silver) containing sodium chloride, an aqueous solution of silver nitrate and an aqueous halide solution containing potassium bromide, sodium chloride, $2.3\times10^{-7}$ mol/mol silver of $Na_3RhCl_6$ and $3.0\times10^{-7}$ mol/mol silver of $Na_2IrCl_6$ were added whilst stirring in accordance with a double jet method. A physical ripening was used to form silver chlorobromide grains having an average grain size of 0.27 μm (variation coefficient: 19%) and a chloride content of 64 mol %. After the physical ripening of the emulsion KI was added to stop crystal growth.

Thereafter, the emulsion was washed using a conventional flocculation method, and then redispersed with 33.3 g/mol silver of gelatin. The resulting emulsion was adjusted to pH 5.3 and then chemically sensitized with gold/sulphur at 50° C. by digesting during three hours. The emulsion was stabilized with $8.4\times10^{-3}$ mol/mol silver of 4-hydroxy-6-methyl-1,3,3a,7-tetraazaindene, and spectrally sensitized with dye SD-1 in an amount of $2.9\times10^{-4}$ mol/mol silver.

SD-1

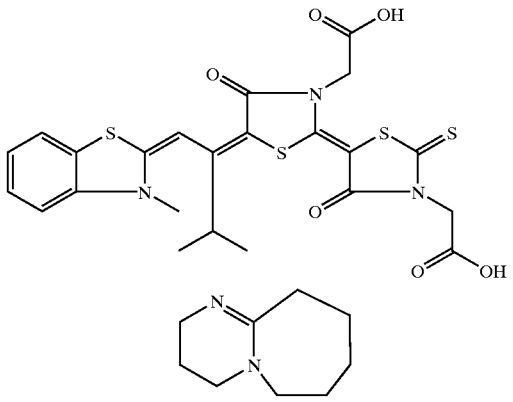

The obtained emulsion had a gelatin/silver ratio of 0.51.

Preparation of the Sample Coated With Emulsion

On the backside of the subbed polyester support, two backing layers were coated simultaneously.

The backing closest to the support contained per m$^2$:

2.44 g of gelatin 0.96 g of polyethylene acrylate (PEA) latex 0.5 g of colloidal silica 100 mg of blue antihalation dye AHD-1:

AHD-1

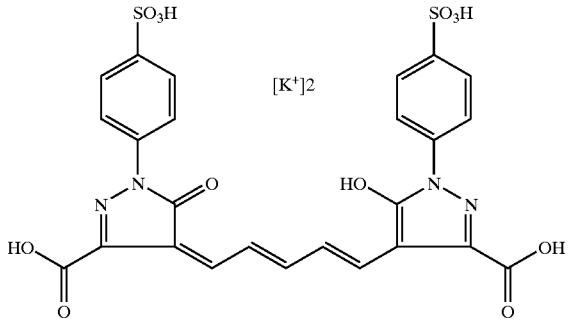

The second backing layer contained per m$^2$:

0.6 g gelatin 50 mg 7 μm PMMA matting agent coating aids

The emulsion layers were coated simultaneously onto the polyethylene terephthalate film support, using a two layer arrangement with the emulsion layer closest to the support and an anti-abrasion layer on top.

The emulsion layer was coated at a pH of 5, with a silver coverage of 3.88 g per square meter of silver. Potassium bromide was added (3.6 mmol/mol silver) to adjust the pAg. To improve curling 300 mg/m$^2$ of a PEA latex was added. This emulsion layer was then overcoated with an anti-abrasion layer at 1.5 g/m$^2$ gelatin and further containing formaldehyde as a hardener, hydroquinone and phenidone as stabilizers, coating aids and a PMMA matting agent (3 μm). After the coating the film sample was dried.

Example 2

Invention

Preparation of Polyester Sample

Composition of the backing subbing layers: a latex conductive subbing layer as in example 1, and a gelatin backing layer comprising 1.2 g/m$^2$ of gelatin, 100 mg/m$^2$ of AHD-1 as antihalation dye and 10 mg/m$^2$ of PMMA matting agent (7 μm) were coated.

Composition of the emulsion side subbing layers: a latex subbing layer containing 162 mg/m$^2$ of a terpolymer of vinylidene chloride/methyl acrylate/itaconic acid (88%/10%/2%), and 40 mg/m$^2$ of colloidal silica; then a gelatin subbing layer holding 0.2 g/m$^2$ of gelatin, 0.2 g/m$^2$ of colloidal silica, and 1 mg/m$^2$ of a 3 μm PMMA matting agent.

Again, both backing subbing layers and emulsion side subbing layers were coated during polyester production.

Preparation of the Emulsion

To an aqueous gelatin solution (23.3 gelatin/mol silver) containing sodium chloride, an aqueous solution of silver nitrate and an aqueous halide solution containing potassium bromide, sodium chloride, $2.3\times10^{-7}$ mol/mol silver of $Na_3RhCl_6$ and $3.0\times10^{-7}$ mol/mol silver of $Na_2IrCl_6$ were added whilst stirring in accordance with a double jet method. A physical ripening was used to form silver chlorobromide grains having an average grain size of 0.27 μm (variation coefficient: 19%) and a chloride content of 64 mol %. After the physical, ripening of the emulsion KI was added to stop crystal growth.

Thereafter, the emulsion was washed using a conventional flocculation method, and then redispersed with 10 g gelatin/mol silver. The resulting emulsion was adjusted to pH 5.3 and then chemically sensitized with gold/sulfur at 50° C. by digesting during three hours. The emulsion was stabilized with $8.4\times10^{-3}$ mol/mol silver of 4-hydroxy-6-methyl-1,3,3a,7-tetraazaindne, spectrally sensitized with dye SD-1 in an amount of $4.0\times10^{-4}$ mol/mol silver.

The obtained emulsion had a gelatin/silver ratio of 0.31.

Preparation of the Sample Coated With Emulsion

The emulsion layers were simultaneously coated onto the polyethylene terephthalate film support, using a three layer arrangement with the emulsion layer closest to the support, then an interlayer, and on top an anti-abrasion layer.

The emulsion layer was coated at a pH of 5, with a silver coverage of 3.23 g per square meter of silver. Potassium bromide was added (3.6 mmol/mol silver) to adjust pAg. This emulsion layer was overcoated with an interlayer containing 0.5 g/m$^2$ of gelatin and 0.5 g/m$^2$ of copoly (AMPS-butylmethacrylate) latex, and hydroquinone and Phenidone as stabilizers.

An anti-abrasion layer was coated on top, with 0.5 g/m$^2$ gelatin containing divinylsulfon hardener, coating aids and a PMMA matting agent.

After the coating the film sample was dried.

Example 3

Invention

Preparation of Polyester Sample

Composition of the backing subbing layers: a latex conductive subbing layer and a gelatin backing layer comprising 1.2 g of gelatin/m$^2$, 100 mg/m$^2$ of AH-1 as antihalation dye and 10 mg/m$^2$ 7 $\mu$m PMMA matting agent were coated.

Composition of the emulsion side subbing layers: a latex subbing layer containing 162 mg/m$^2$ of a terpolymer of vinylidene chloride/methyl acrylate/itaconic acid (88%/10%/2%), and 40 mg/m$^2$ of colloidal silica; then a gelatin subbing layer holding 0.2 g/m$^2$ of gelatin, 0.2 g/m$^2$ of colloidal silica, and 0.025 mg/m$^2$ of a 1 $\mu$m PMMA matting agent.

Again, both backing subbing layers and emulsion side subbing layers were coated during polyesterproduction.

Preparation of the Emulsion

To an aqueous gelatin solution (16.7 gelatin/mol silver) containing sodium chloride, an aqueous solution of silver nitrate and an aqueous halide solution containing potassium bromide, sodium chloride, $2.3\times10^{-7}$ mol/mol silver of $Na_3RhCl_6$ and $3.0\times10^{-7}$ mol/mol silver of $Na_2IrCl_6$ were added with stirring in accordance with a double jet method. A physical ripening was used to form silver chlorobromide grains having an average grain size of 0.27 $\mu$m (variation coefficient: 19%) and a chloride content of 64 mol %. After the physical ripening of the emulsion KI was added to stop crystal growth.

Thereafter, the emulsion was washed using a conventional flocculation method, and then redispersed with 6.7 g gelatin/mol silver. The resulting emulsion was adjusted to pH 5.3 and then chemically sensitized with gold/sulphur at 50° C. by digesting during three hours. The emulsion was stabilized with $8.4\times10^{-3}$ mol/mol silver of 4-hydroxy-6-methyl-1,3,3a,7-tetraazaindene, spectrally sensitized with dye SD-1 in an amount of $4.0\times10^{-4}$ mol/mol silver.

The obtained emulsion had a gelatin/silver ratio of 0.22.

Preparation of Coated Emulsion Sample

The emulsion layers were simultaneously coated onto the polyethylene terephthalate film support, using a three layer arrangement with the emulsion layer closest to the support, then an interlayer and finally an anti-abrasion top layer.

The emulsion layer was coated at a pH of 5, with a silver coverage of 2.72 g per square meter of silver. Potassium bromide was added (3.6 mmol/mol silver) to adjust pAg. To improve curling 0.6 g/m$^2$ of copoly(AMPS-butylmethacrylate) latex was added.

This emulsion layer was overcoated with an interlayer comprising 0.5 g/m$^2$ of gelatin and 0.5 g/m$^2$ of copoly (AMPS-butylmethacrylate) latex, hydroquinone and Phenidone as stabilizers.

An anti-abrasion layer was coated on top, with 0.5 g gelatin/m$^2$ containing divinylsulfon hardener, 0.8 ml/m$^2$ of a 20% polyethylene dispersion, coating aids and a PMMA matting agent.

After the coating the film sample was dried.

Example 4

Invention

The composition of the subbing and antihalatlon layers, and the preparation of the emulsion were the same as in example 3.

Preparation of Coated Emulsion Sample

The emulsion layers were coated simultaneously onto the polyethylene terephthalate,film support, using a three layer arrangement with the emulsion layer closest to the support, then an interlayer, and finally an anti-abrasion top layer.

The emulsion layer was coated at a pH of 5, with a silver coverage of 2.72 g per square meter of silver. Potassium bromide was added (3.6 mmol/mol silver) to adjust pAg.

This emulsion layer was overcoated with an interlayer comprising 0.5 g/m$^2$ of gelatin and and 0.5 g/m$^2$ of copoly (AMPS-butylmethacrylate) latex, hydroquinone and Phenidone as stabilizers.

An anti-abrasion layer was coated on top, with 0.5 g gelatin/m$^2$ and further containing divinylsulfon hardener, coating aids and a PMMA matting agent.

After the coating the film sample was dried.

Example 5

Invention

The composition of the subbing and antihalation layers, and the reparation of the emulsion were the same as in example 3 and 4.

Preparation of Coated Emulsion Sample

The emulsion layers were simultaneously coated onto the polyethylene terephthalate film support, using a three layer arrangement with the emulsion layer closest to the support, then an interlayer, and finally an anti-abrasion top layer.

The emulsion layer was coated at a pH of 5, with a silver coverage of 2.63 g per square meter of silver. Dextrane was added in an amount of 0.675 ml/m$^2$ of a 20% solution. Potassium bromide was added (3.6 mmol/mol silver) to adjust pAg.

This emulsion layer was overcoated with an interlayer containing 0.5 g/m$^2$ of gelatin and 0.5 g/m$^2$ of copoly (AMPS-butylmethacrylate) latex, hydroquinone and Phenidone as stabilizers.

An anti-abrasion layer was coated on top, with 0.5 g/m$^2$ gelatin and further containing divinylsulfon hardener, coating aids and a PMMA matting agent.

After the coating the film sample was dried.

Exposure and Photographic Processing of the Coated Samples

Each sample was exposed co a laser sensitometer using a 670 nm laserdiode, through a continuous wedge, and then developed for 15 or 30 seconds at 35° C. with developer A. Thereafter, each sample was subjected successively to fixation in a conventional ammonium thiosulphate containing fixation bath, and then to washing and drying operations. The processing took place in a Rapiline 66T3 processor, trade name of Agfa-Gevaert N.V.

Composition of Developer A

| Composition | Value |
|---|---|
| Water | 800 ml |
| Potassium carbonate | 29.5 g |
| Potassium sulfite | 34.1 |
| Potasium bromide | 2.4 |
| Diethylene glycol | 14 ml |
| Hydroquinone | 17 |
| Sodium erythorbate | 2.5 |
| 4-Hydroxymethyl-4-methyl-1-phenyl-3-pyrazolidone | 0.275 |
| Methylbenzotriazole | 0.06 |
| Water to adjust the volume to | 11 |
| Sodium hydroxide to adjust the pH to | 10.5 |

Evaluation of Exposed Samples

Water-absorption

The samples were soaked for 2 minutes in water. Afterwards, the water remaining on the surface was removed. The water absorption is the difference in weight before and after.

Sensitivity

After exposure through a wedge the density was measured. The sensitivity was measured at a density of 3.0 above fog. Higher figure means less sensitive.

Gradation

Gradation is measured between density 0.1 and 0.5 above fog.

Development Speed

Difference in sensitivity between 30 sec and 15 sec developing time is a measure for the developing speed. Lower figures are better.

Covering Power

After exposure in a laser sensitometer with a 670 nm laserdiode, and developing for 30 seconds the maximum density (Dmax) was measured using a densitometer Macbeth TD904. The covering power of the silver was calculated by the following formula:

$$\text{Covering power} = \text{Dmax/coated silver coverage (in g silver/m}^2\text{)}$$

The summary of the composition is given in Table 1.

The obtained results of the samples are included in Table 2.

TABLE 1

| Example | Silver-coverage | gelatin in emulsion layer | latex in emulsion * | Extra ingredient | Note |
|---|---|---|---|---|---|
| 1 | 3.88 | 1.98 | 15 | | Comparison |
| 2 | 3.23 | 1.00 | 0 | | Invention |
| 3 | 2.72 | 0.60 | 50 | | Invention |
| 4 | 2.72 | 0.60 | 0 | | Invention |
| 5 | 2.63 | 0.53 | 0 | Dextrane | Invention |

* : amount latex divided by thhe total amount of solids, without silver halide.

TABLE 2

| Ex. | Water-absorption Backing | Water-absorption Emulsion | Sensitivity | Gradation | Development speed | Covering power | Note |
|---|---|---|---|---|---|---|---|
| 1 | 6.34 g/m$^2$ | 5.61 g/m$^2$ | 143 | 328 | 9 | 1.49 | Comp. |
| 2 | 0.52 g/m$^2$ | 3.74 g/m$^2$ | 141 | 394 | 7 | 1.84 | Inv. |
| 3 | 0.52 g/m$^2$ | 3.46 g/m$^2$ | 143 | 356 | 7 | 1.83 | Inv. |
| 4 | 0.52 g/m$^2$ | 3.15 g/m$^2$ | 137 | 428 | 3 | 1.82 | Inv. |
| 5 | 0.52 g/m$^2$ | 3.19 g/m$^2$ | 140 | 499 | 9 | 1.99 | Inv. |

As it is clear from the table the gradations af the invention samples are higher. This results in a better image quality of the film on laser recorders.

The examples of the invention clearly show an important improvement in water absorption, so that the amount of replenishment needed is lowered. The material will also dry much faster in an automatic processor.

Since the developing speed is also higher it is possible to process the invention sample at a higher speed than the comparison.

Also the covering power is increased. So the costprice of the material can be reduced significantly.

What is claimed is:

1. A photographic recording material for graphic arts comprising a polyester support, subbed on both front and back sides with a latex subbing layer, and further comprising on the front side a gelatin subbing layer, one or more red sensitized emulsion layers having a total silver coverage of at most 3.6 g/m$^2$ silver, and a total dry coverage of all other solid ingredients of at most 1.5 g/m$^2$, and one or more anti-abrasive layers.

2. A photographic recording material for graphic arts according to claim 1 further comprising on the back side an antihalation layer comprising at most 1.5 g/m$^2$ of gelatin and an antihalation dye.

3. A photographic recording material for graphic arts according to claim 1 wherein said other solid ingredients of said emulsion layer comprise gelatin and a latex wherein the amount of latex is at least 15% by weight of said other solid ingredients.

4. A photographic recording material for graphic arts according to any of claim 1 wherein said one or more anti-abrasive layers consist of a double layer, the top layer of which comprising gelatin, and of the one closest to the support comprising a mixture of gelatin and a latex.

5. A photographic recording material for graphic arts according to any of claim 1 wherein said latex subbing layer on the front side or said gelatin subbing layer on the front side comprises a polymeric spacing agent having an average particle size of at most 1.5 $\mu$m.

6. A photographic recording material for graphic arts according to any of claim 1 wherein said latex subbing layer on both sides of the polyester support, said gelatin subbing layer on the front side, and said antihalation layer on the back side are coated on line in the manufacturing alley of the polyester support.

7. A photographic recording material for graphic arts according to any of claim 1 wherein said emulsion layer and said one or more anti-abrasion layers are coated by means of curtain coating.

* * * * *